US011186392B2

(12) United States Patent
Pedrazzi et al.

(10) Patent No.: US 11,186,392 B2
(45) Date of Patent: Nov. 30, 2021

(54) DISTRIBUTION UNIT FOR FEEDING LIDS TO NECKS OF CONTAINERS

(71) Applicant: Tetra Laval Holdings & Finance S.A., Pully (CH)

(72) Inventors: Alessandro Pedrazzi, Modena (IT); Romano Sighinolfi, Nonantola Modena (IT); Massimo Viola, Marano sul Panaro Modena (IT); Mauro Cavazzuti, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 354 days.

(21) Appl. No.: 15/776,271

(22) PCT Filed: Feb. 2, 2017

(86) PCT No.: PCT/EP2017/052286

§ 371 (c)(1),
(2) Date: May 15, 2018

(87) PCT Pub. No.: WO2017/137308

PCT Pub. Date: Aug. 17, 2017

(65) Prior Publication Data

US 2020/0255171 A1 Aug. 13, 2020

(30) Foreign Application Priority Data

Feb. 12, 2016 (EP) ..... 16155511

(51) Int. Cl.
*B65B 7/28* (2006.01)
*B67B 3/20* (2006.01)

(52) U.S. Cl.
CPC ..... *B65B 7/2807* (2013.01); *B65B 7/2835* (2013.01); *B67B 3/20* (2013.01); *B67B 3/204* (2013.01); *B67B 2201/06* (2013.01)

(58) Field of Classification Search
CPC ..... B65B 7/2835; B65B 7/2807; B65B 3/06; B65B 3/00; B65B 3/20; B65B 65/00;
(Continued)

(56) References Cited

U.S. PATENT DOCUMENTS 1,835,335 A * 12/1931 Risser ..... B67B 3/2033 53/317
2,053,763 A * 9/1936 Brinton ..... B67B 3/064 53/67

(Continued)

FOREIGN PATENT DOCUMENTS

DE 20 2013 007104 9/2013

OTHER PUBLICATIONS

International Search Report from corresponding PCT Application No. PCT/EP2017/052286 dated Feb. 28, 2017 (4 pages).

(Continued)

*Primary Examiner* — Robert F Long
*Assistant Examiner* — Eduardo R Ferrero
(74) *Attorney, Agent, or Firm* — Finnegan, Henderson, Farabow, Farrett & Dunner LLP

(57) ABSTRACT

A distribution unit for feeding lids (1) to necks (9) of containers (10) comprises a chute element (102) arranged for receiving a row of lids (1), an outlet opening (103) arranged for releasing said lids (1) one at a time, said outlet opening (103) being intended to be positioned above a conveying device (100) suitable for conveying said containers (10) along an advancement direction (F) so that each of said containers (10) interacts with said chute element (102) to remove a corresponding lid (1) from said outlet opening (103), said distribution unit (101) further comprising a guide element (105) having an active surface (106) extending on an opposite side of said chute element (102) with respect to said outlet opening (103) and arranged for interacting with (Continued)

said lids (1), said active surface (106) having a stepped profile.

10 Claims, 7 Drawing Sheets

(58) Field of Classification Search
CPC ..... B67B 3/06; B67B 3/062; B67B 3/064; B67B 3/0645; B67B 3/20; B67B 3/204; B67B 3/2053; B67B 2201/06; B67B 2201/017; B67B 2201/00
USPC ..... 53/310, 312–315, 317, 331.5
See application file for complete search history.

(56) References Cited

U.S. PATENT DOCUMENTS 2,132,335 A * 10/1938 White ..... B67B 3/064 53/315
2,337,032 A * 12/1943 Davies ..... B67B 3/02 53/315
2,357,826 A * 9/1944 Hohl ..... B65B 7/28 53/287
2,386,797 A * 10/1945 Hohl ..... B65B 7/2807 53/316
2,435,127 A * 1/1948 Cameron ..... B67B 3/2046 53/314
2,518,856 A * 8/1950 Bell ..... B65B 7/28 53/406
2,522,437 A * 9/1950 Enkur ..... B67B 3/24 53/110
2,805,532 A * 9/1957 Anderson ..... B65B 7/2807 53/314
2,835,963 A * 5/1958 Thomson, Jr. ..... B67B 3/064 29/714
2,876,605 A * 3/1959 McElroy ..... B67B 3/2046 53/315
2,931,147 A * 4/1960 Barnby ..... B65B 31/046 53/432
2,954,900 A * 10/1960 Brubaker ..... B65B 7/2807 221/211
2,972,184 A * 2/1961 Andrew ..... B65B 7/2821 29/773
3,012,388 A * 12/1961 Stover ..... B65B 7/2835 53/315
3,054,234 A * 9/1962 Stover ..... B67B 3/2046 53/490
3,100,957 A * 8/1963 King ..... B65B 7/2807 53/67
3,137,982 A * 6/1964 Judson ..... B65B 7/2807 53/316
3,332,209 A * 7/1967 Knudsen ..... B65B 7/2807 53/313
3,332,210 A * 7/1967 Renato ..... B65B 7/2807 53/316
3,345,801 A * 10/1967 West ..... B65B 7/2807 53/311
3,364,653 A * 1/1968 Wyard ..... B65B 7/2807 53/315
3,380,225 A * 4/1968 Ochs ..... B65B 55/10 53/110
3,438,174 A * 4/1969 Foss ..... B65B 7/2807 53/110
3,460,314 A * 8/1969 Keas ..... B65B 7/2807 53/72
3,533,216 A * 10/1970 Lange ..... B65B 7/2807 53/314
3,656,605 A * 4/1972 Gess ..... B65G 47/14 198/402
3,755,987 A 9/1973 Dardaine et al.
3,800,501 A * 4/1974 Raatz ..... B67B 3/2053 53/315
3,874,147 A * 4/1975 Zetterberg ..... B67B 3/2046 53/314
3,908,341 A * 9/1975 Conti ..... B67B 3/06 53/314
3,924,384 A * 12/1975 Kinney ..... B65B 43/50 53/485
3,977,161 A * 8/1976 Faber ..... B65B 7/2807 53/313
4,077,188 A * 3/1978 Strombeck ..... B65B 7/2807 221/273
4,199,914 A * 4/1980 Ochs ..... B67B 3/2046 53/314
4,246,738 A * 1/1981 Ono ..... B67B 3/2033 53/331.5
4,279,115 A * 7/1981 Roberts ..... B67B 3/2046 53/314
4,601,160 A * 7/1986 Heisler ..... B65B 7/2842 193/47
4,608,806 A * 9/1986 Haslam ..... B67B 3/2046 53/314
4,932,824 A * 6/1990 Goslin ..... B65B 7/2807 193/27
5,012,630 A * 5/1991 Ingram ..... B65B 7/2835 53/314
5,398,480 A * 3/1995 Bankuty ..... B67B 3/06 53/315
5,426,912 A * 6/1995 Hall ..... B65B 7/28 53/313
5,699,654 A * 12/1997 van den Akker ..... B67B 3/06 53/314
5,960,989 A * 10/1999 Gunderson ..... B65G 59/106 221/220
6,141,939 A * 11/2000 Pedrotti ..... B65B 7/2814 53/314
7,412,811 B2 * 8/2008 Marcus ..... B65B 31/043 141/4
2003/0159408 A1 8/2003 Seebeger et al.
2007/0056251 A1 3/2007 Ruppman, Sr. et al.
2010/0064631 A1 * 3/2010 Krauss ..... B67B 3/0645 53/167
2010/0170768 A1 * 7/2010 Pedrazzi ..... B65B 61/186 198/470.1
2011/0138740 A1 * 6/2011 Evers ..... B67B 3/003 53/167
2012/0110949 A1 * 5/2012 Roth ..... B67B 3/06 53/285
2015/0107197 A1 * 4/2015 Plessner ..... B65B 7/2807 53/485
2018/0244416 A1 * 8/2018 Canalini ..... B65B 7/2835
2018/0281999 A1 * 10/2018 Canalini ..... B29C 66/8242
2018/0282001 A1 * 10/2018 Canalini ..... B65D 41/0471

OTHER PUBLICATIONS

Chinese Office Action cited in corresponding Chinese Application No. 201780004130.4 dated Feb. 6, 2020 (7 pgs.).

* cited by examiner

DISTRIBUTION UNIT FOR FEEDING LIDS TO NECKS OF CONTAINERS

CROSS-REFERENCE TO RELATED PATENT APPLICATIONS

This is a National Phase of International Application No. PCT/EP2017/052286, filed Feb. 2, 2017, which claims the benefit of European Application No. 16155511.5 filed Feb. 12, 2016. The entire contents of the above-referenced applications are expressly incorporated herein by reference.

TECHNICAL FIELD

The invention relates to a distribution unit for feeding lids to necks of containers, particularly sealed containers for packaging pourable food products. The distribution unit according to the invention is especially suitable for applying a lid onto a neck that has been moulded on a sheet packaging material, the latter being in turn adapted to be folded, filled with a pourable food product and sealed to form a container.

BACKGROUND OF INVENTION

As known, many pourable food products, such as fruit juice, UHT (ultra-high-temperature treated) milk, wine, tomato sauce, etc., are sold in containers made of sterilized sheet packaging material.

A typical example of this type of containers is the parallelepiped-shaped container for liquid or pourable food products known as Tetra Brik Aseptic (registered trademark), which is made by folding and sealing laminated strip packaging material.

The packaging material has a multilayer structure substantially comprising a base layer for stiffness and strength, which may include a layer of fibrous material, e.g. paper, or mineral-filled polypropylene material, and a number of lamination layers of heat-sealable plastic material, e.g. polyethylene films, covering both sides of the base layer.

In the case of aseptic containers for long-storage products, such as UHT milk, the packaging material also comprises a layer of gas-barrier material, e.g. aluminium foil or ethyl vinyl alcohol (EVOH) film, which is superimposed on a layer of heat-sealable plastic material, and is in turn covered with another layer of heat-sealable plastic material forming the inner face of the container eventually contacting the food product.

Containers of this sort are normally produced on fully automatic packaging machines, which are fed with a web of packaging material that is sterilized in the packaging machine, e.g. by applying a chemical sterilizing agent, such as a hydrogen peroxide solution, which, once sterilization is completed, is removed from the surfaces of the packaging material, e.g. evaporated by heating. The web of packaging material so sterilized is then maintained in a closed, sterile environment, and is folded and sealed longitudinally to form a vertical tube.

The tube is filled with a sterilized or sterile-processed food product, and is sealed and subsequently cut along equally spaced cross sections to form pillow packs, which are then folded mechanically to form respective finished, e.g. substantially parallelepiped-shaped, containers.

Alternatively, the packaging material may be cut into blanks, which are formed into containers on forming spindles, and the containers are filled with the food product and sealed. One example of this type of container is the so-called "gable-top" container known by the trade name Tetra Rex (registered trademark).

To open the containers described above, various solutions have been proposed, including reclosable opening devices made of plastic material and substantially comprising a pouring spout, defining a through pouring opening and fitted to a hole in a wall of the container.

When producing the opening device, the opening of the pouring spout is sealed by a closing element connected integrally to the pouring spout and detachable from it along a normally circular tear line. The closing element extends at the same level as the packaging material, so as to seal the hole in the wall of the container. On the side facing the lid, the closing element has an integral projecting pull ring, the free end of which is pulled by the user to detach the closing element from the pouring spout along the tear line and so open the pouring opening. More specifically, the pull ring extends inside, and at a predetermined distance from, the pouring spout.

It is also possible to fix the closing element of the opening device directly over a prelaminated hole in the packaging material, i.e. a hole formed in the base layer only and covered by the other lamination layers, including the layer of gas-barrier material.

In both cases, a removable, e.g. screw or hinged, lid, is subsequently fitted to the pouring spout in order to outwardly close the latter.

According to another solution, the closing element of the opening device is formed in one piece with a protruding portion extending inside the pouring spout and welded to the lid. The latter is provided with a disk-shaped welding promoting element that is welded to the protruding portion so that, when removing the lid from the pouring spout, the protruding portion and the closing element remain attached to the lid.

In any case, the containers are formed, filled and sealed in a filling machine. When coming out from the filling machine, each container has a neck that defines the pouring spout. The neck is closed by a respective closing element, and protrudes from a top wall of the container.

Downstream of the filling machine, there is provided an applying unit for applying lids to the necks of the containers.

The applying unit comprises a conveyor along which the containers are advanced and wherein a lid is placed on a respective neck and a capping unit that screws the lid onto the neck.

Distribution units are known that delivers a lid to a corresponding neck of a container while the container is being advanced by the conveyor.

The known distribution units comprise a chute containing a row of lids. The chute has an outlet projecting on the conveyor so that the neck of the container interacts with the lid closer to the outlet of the chute, i.e. the first lid of the row, and removes the lid from the chute.

A drawback of these distribution units is that the lid may be incorrectly positioned on the neck. This is due to the fact that the lid is removed from the chute by the moving neck. The removal, therefore, is highly affected by the interaction between the neck and the lid at the outlet of the chute.

Since the position of the container with respect to the conveyor can vary—within a certain range of tolerance—from container to container and the position of the lid with respect to the outlet of the chute can vary—within a certain range of tolerance—from lid to lid, the final position of the lid on the container cannot be completely controlled. This may create problems in the capping unit, when the lid has to be screwed on the neck.

In addition, in case of containers made of packaging material having a multilayer structure, for example cardboard-based multilayer packaging material, it may happen that when the neck interacts with the lid at the outlet of the chute a top panel of the container is deformed, i.e. the top panel passes from a substantially planar configuration to a curved configuration, and therefore the lid is not placed in the right position with respect to the neck.

In addition, even in case the lid is placed in the right position with respect to the neck it may happen that, when the deformation of the top panel of the container is released, i.e. the top panel moves back from the curved configuration to the substantially planar configuration, the cap is expelled from the neck.

DISCLOSURE OF INVENTION

An object of the invention is to improve the distribution units for feeding lids to necks of containers.

A further object is to improve accuracy of distribution units for feeding lids to necks of containers, without excessively complicating the mechanical structure of the distribution units.

A further object is to provide a distribution unit that can precisely feed lids to necks of deformable containers, for example container made of packaging material having a multilayer structure.

According to the invention there is provided a distribution unit for feeding lids to necks of containers as claimed in claim 1.

BRIEF DESCRIPTION OF THE DRAWINGS

The invention will be better understood and carried out with reference to the enclosed drawings, which show an exemplifying and non-limiting embodiment thereof, in which.

DETAILED DESCRIPTION OF PREFERRED EMBODIMENTS

Figure 1:
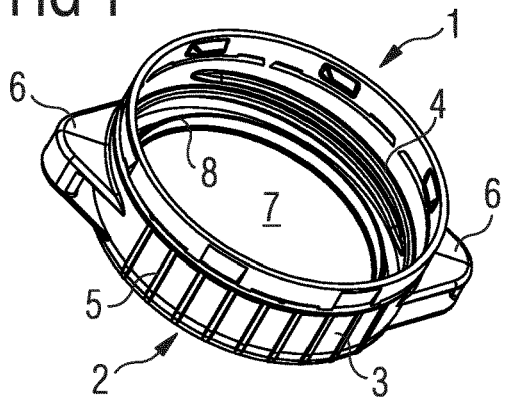
FIG. 1 is a perspective view of a lid intended to be applied onto a neck of a container.

FIG. 1 shows a lid 1 intended to be applied onto a container neck. The lid 1 comprises an end wall 2, which may be shaped as a disk, particularly a circular disk. The lid 1 further comprises a side wall 3, which may be substantially cylindrical, appended to the end wall 2.

The side wall 3 extends around an axis of the lid 1, whereas the end wall 2 extends transversely, in particular perpendicularly, to the axis of the lid 1.

The side wall 3 is provided with one or more internal threads 4 capable of engaging with corresponding threads obtained on the container neck. The side wall 3 may be externally provided with a plurality of knurls 5, which allow a user to more easily grip the lid 1.

Two appendages 6 project from an outer surface of the side wall 3, at diametrically opposite positions.

A welding promoting element 7, which may be for example disk-shaped, is anchored to an inner surface of the end wall 2, i.e. to a surface that, in use, faces the container neck.

The lid 1 may comprise an annular rib 8, obtained integrally with the end wall 2, which axially protrudes from the end wall 2 towards the inside of the lid 1. The annular rib 8 defines a seat for receiving the welding promoting element 7.

The welding promoting element 7 is defined by a multilayer sheet element distinct from the end wall 2 and permanently connected to the latter. In particular, the welding promoting element 7 comprises a layer of conductive material, e.g. an aluminium foil, and at least two layers of heat-sealable plastic material, e.g. polyethylene films, covering both sides of the layer of conductive material and defining respective opposite faces of the welding promoting element 7. A face of the welding promoting element 7 is welded to the end wall 2 by the heat generated when inducing a current in the layer made of conductive material.

Figure 2:
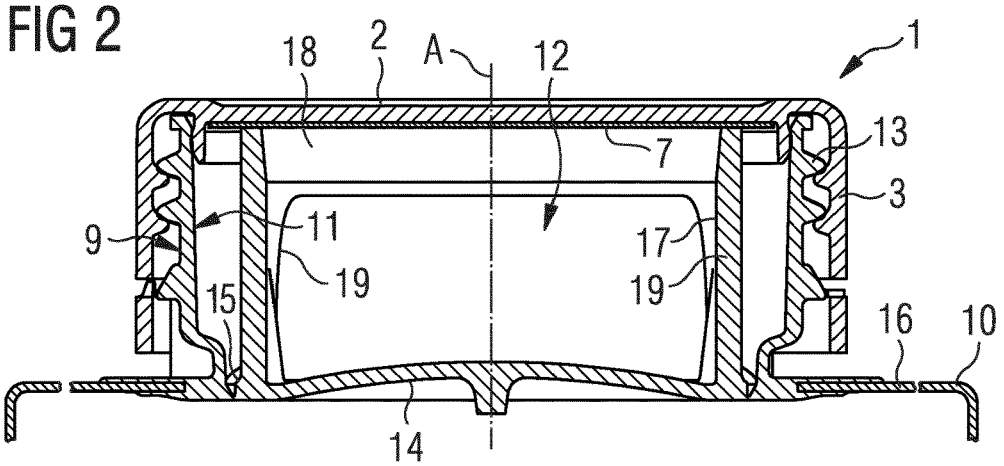
FIG. 2 is an enlarged cross-section showing the lid of FIG. 1, screwed onto a corresponding neck.

As shown in FIG. 2, the lid 1 is intended to be applied onto a neck 9 of a container 10, particularly a sealed container for packaging pourable food products.

The container can be made of a packaging material having a multilayer structure, as disclosed in the introductory part of this patent application.

The neck 9 is included in an opening device comprising a pouring spout 11 fixed to the packaging material forming the container 10. The neck 9 has a substantially cylindrical tubular shape and extends around an axis A.

The neck 9 defines a pouring opening 12, through which the content of the container 10 can be poured by a user. On an outer surface of the neck 9, extending around the axis A, one or more outer threads 13 are provided, which are capable of engaging with the inner threads 4 of the lid 1. Thus, the lid 1 can be removably coupled to the neck 9. When the lid 1 is screwed onto the neck 9, the axis of the lid 1 is coincident with the axis A of the neck 9.

The pouring opening 12 is initially closed by a closing element 14 that is integrally connected to the pouring spout 11 at a tear line 15, along which the closing element 14 can be detached from the pouring spout 11.

The pouring spout 11 and the closing element 14 are formed in one piece on a receiving portion 16 of the packaging material forming the container 10, whilst the lid 1 is formed separately from the pouring spout 11 and the closing element 14, and then fitted thereto. The pouring spout 11 and the closing element 14 may be obtained by moulding molten plastic material—in particular by an injection moulding operation—on the packaging material before it is transformed into a container 10.

The receiving portion 16 may be defined by a so called pre-laminated hole made in the packaging material forming the container 10, i.e. a hole made through a base layer of the packaging material and covered by one, two, or more lamination layers of the packaging material, which seal the hole. In an alternative embodiment, the receiving portion 16 may be simply defined by a hole made through the whole thickness of the packaging material forming the container 1, which is intended to be sealed by the pouring spout 11 and the closing element 14. In another embodiment, the receiving portion 16 may be defined by a patch fixed to the rest of packaging material to seal a hole formed, in this case, through the whole thickness of the packaging material.

The closing element 14 is formed in one piece with a protruding portion 17 extending through the pouring opening 12. The protruding portion 17 is intended to be welded to the welding promoting element 7, after the lid 1 has been screwed onto the neck 9.

The protruding portion 17 may comprise an annular body 18 for contacting the welding promoting element 7, and two or more legs 19 for connecting the annular body 18 to the closing element 14. In the example shown, the legs 19 are diametrically opposite one another.

The container 10 is formed, filled and sealed in a filling machine and is already provided with the pouring spout 11, the closing element 14 and the protruding portion 17 when leaving the filling machine. Thereafter, as will be described in greater detail hereinbelow, an applying head screws a lid 1 onto the neck 9. The welding promoting element 7 of the lid 1 is then welded to the protruding portion 17, by inducing an electric current in the conductive layer of the welding promoting element 7. This current melts the heat-sealable layer of the welding promoting element 7 that faces the neck 9, thereby permanently joining the welding promoting element 7 to the protruding portion 17.

In use, the first opening of the container 10 is obtained by rotating the lid 1 relative to the pouring spout 11 around the axis A. At the beginning of the rotation impressed by the user on the lid 1, the legs 19 bend in the direction of rotation, thereby exerting a pulling action on the closing element 14 at a given point of the tear line 15. In other words, due to the legs 19, the torque exerted on the lid 1 is transformed in a pulling action on the closing element 14, which starts to detach from the pouring spout 11 at two given points along the tear line 15.

Figure 3:
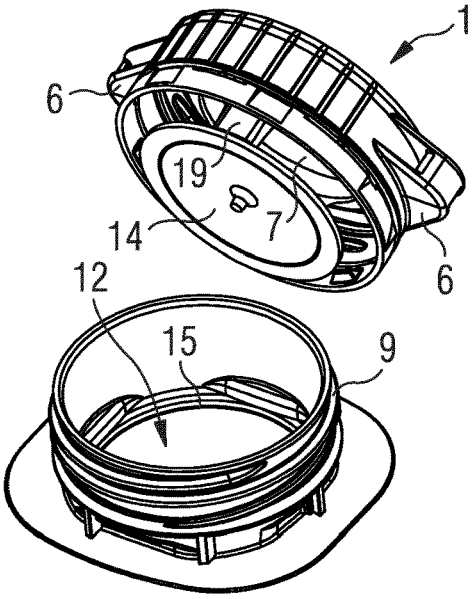
FIG. 3 is a perspective view showing the lid and neck of FIG. 2, when the lid has been removed from the respective container by a user.

By continuing to rotate the lid 1, the latter unscrews completely from the pouring spout 11. As shown in FIG. 3, the closing element 14 is fully detached from the pouring spout 11 along the tear line 15, and remains attached to the lid 1. At this point, the user can pour the content of the container 10 through the pouring opening 12.

The user can then use the lid 1 to again close or open the container 10, by screwing the lid 1 onto the neck 9 or, respectively, unscrewing the lid 1 from the neck 9, as often as desired.

Figure 4:
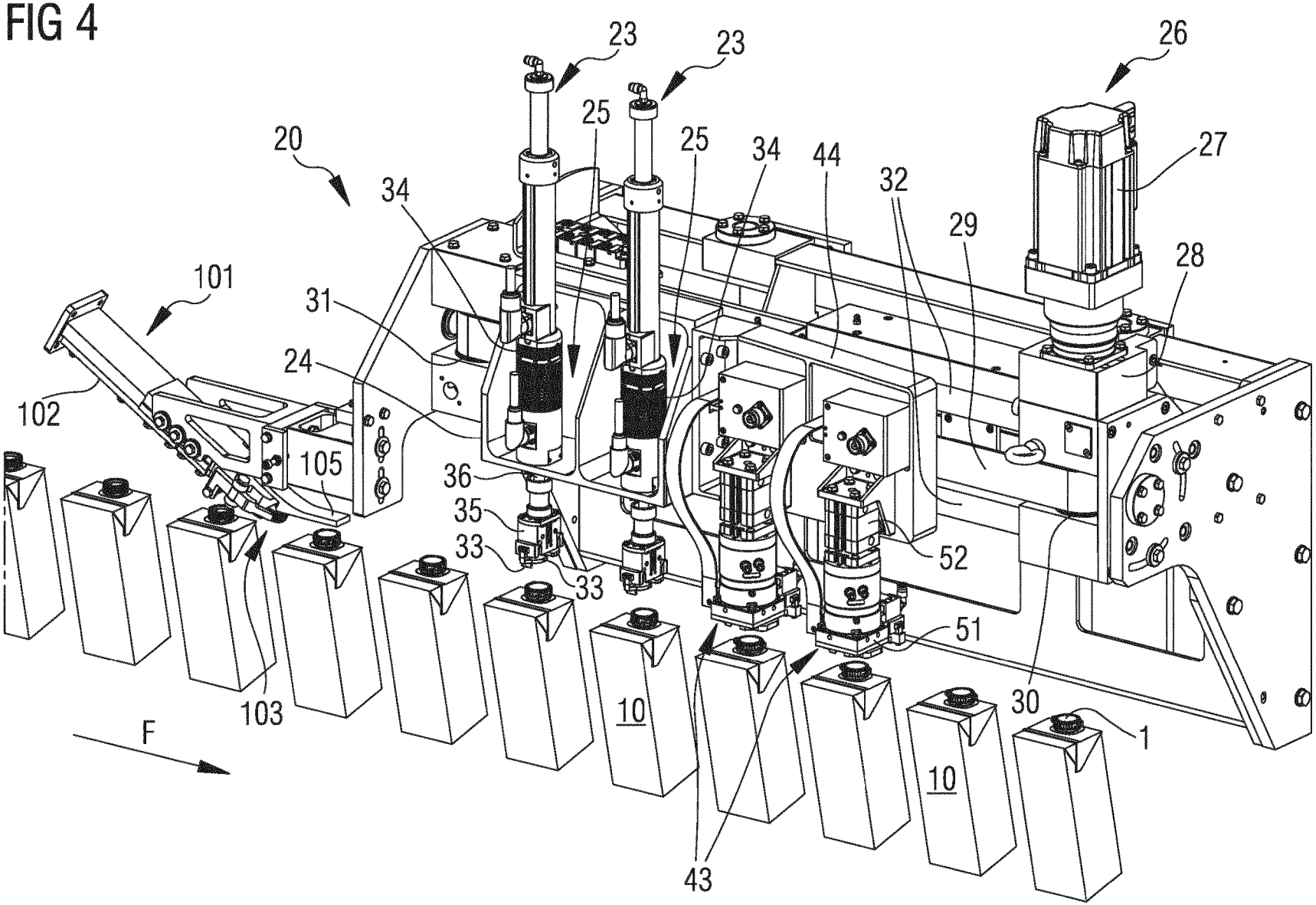
FIG. 4 is a perspective view showing an apparatus for applying lids onto corresponding necks of containers.
Figure 5:
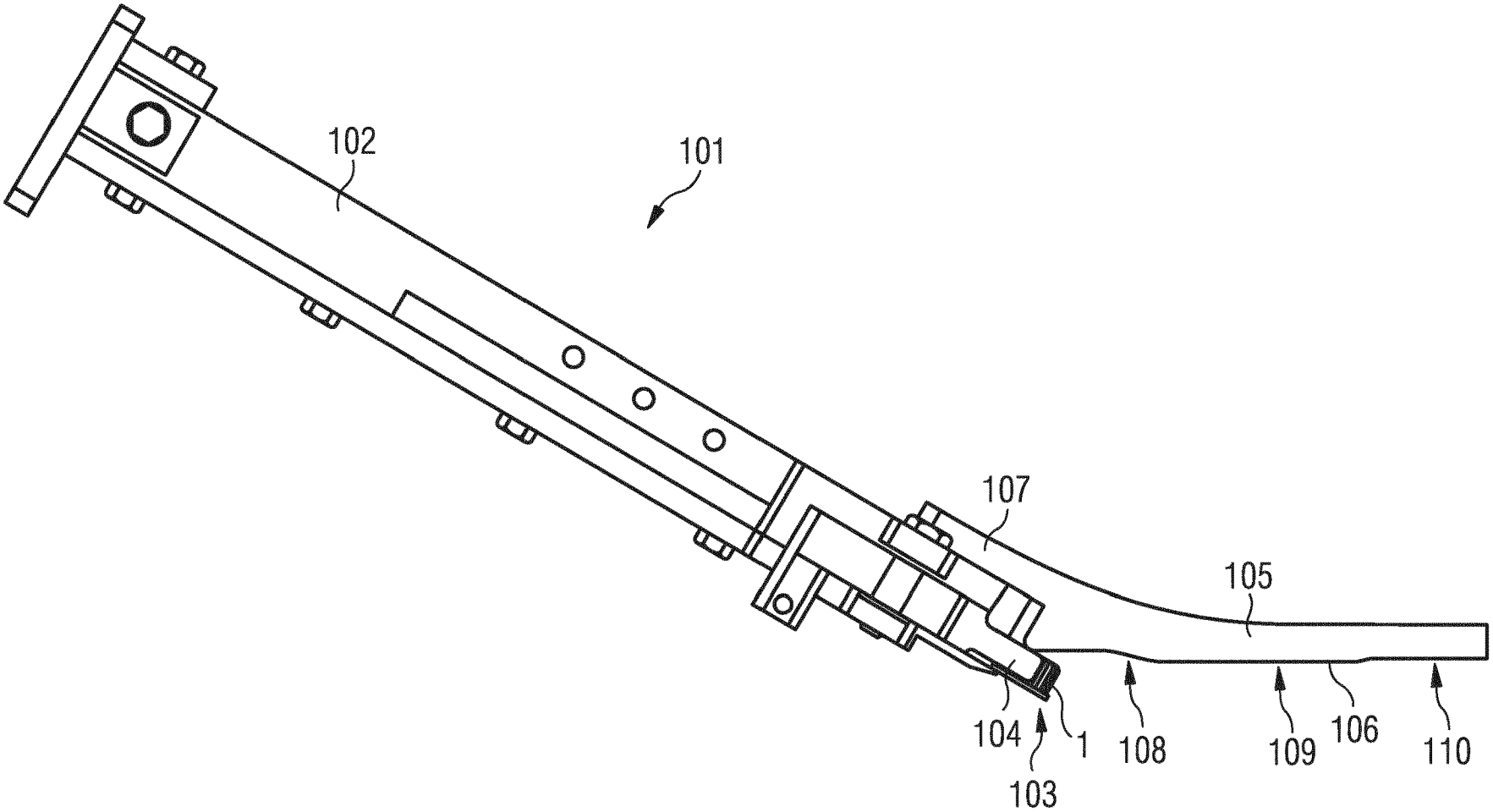
FIG. 5 is a side view of a distribution unit for feeding lids to necks of containers.

FIG. 4 shows an applying unit or apparatus 20 for applying lids 1 onto respective containers 10, which have already been formed, filled and sealed in a filling machine provided upstream of the apparatus 20.

Each container 10 has, in the embodiment shown, a substantially parallelepiped body and a slanted top wall, i.e. a top wall that is inclined with respect to a base wall of the container 10. In other words, when the base wall of the container 10 rests on a horizontal surface, the top wall is inclined with respect to a horizontal plane parallel to the base wall.

In another embodiment, not shown, each container 10 has a substantially parallelepiped body and a top wall substantially parallel to the base wall.

In general, the apparatus 20 may work with containers 10 having different shapes and/or dimensions.

The apparatus 20 comprises a conveying device 100 (shown in FIGS. 6 to 9) for advancing the containers 10 in an advancement direction F, particularly along a rectilinear path. The conveying device 100 comprises a linear conveyor, for example a belt conveyor or a roller conveyor. The conveying device 100 is configured to advance the containers 10 continuously along the advancement direction F.

Upstream of the conveying device 100, a sequencing device may be provided, in order to arrange the containers 10 at a preset distance one from another, i.e. in a sequence having a preset pitch. It is thus ensured that the containers 10 are regularly spaced when entering the apparatus 20.

The apparatus 20 further comprises a distribution unit 101 for feeding the lids 1 to the necks 9 of the containers 10 advancing along the advancement direction F.

The distribution unit 101 comprises a chute element 102 arranged for receiving a row of lids.

The distribution unit further comprises a feeding unit, which is not shown, for supplying the lids 1 to the chute element 102.

The chute element 102 is inclined with respect to the conveying device 100, so that the distance between the chute element 102 and the conveying device 100 decreases when moving along the advancement direction F.

The chute element 102 has an outlet opening 103 arranged for releasing the lids one at a time.

At the outlet opening 103, the chute element 102 has a couple of flexible retaining element 104 that loosely retains one lid 1, i.e. the first lid of the above-mentioned row.

The distribution unit 101 is positioned above the conveying device 100 so that each container 10 being advanced by the conveying device 100 interacts with the chute element 102 to remove a corresponding lid 1 from the outlet opening 103.

The distribution unit 101 further comprises a guide element 105.

The guide element 105 comprises a fastening portion 107 connected to the chute element 102 by means of connecting elements, for example nuts.

The guide element 105 comprises an active surface 106 extending on the opposite side of the chute element 102 with respect to the outlet opening 103 and arranged for interacting with the lids 1.

The active surface 106 faces towards the conveying device 100, i.e. towards the necks 9 on which the lids 2 have to be applied.

The active surface 106 has a stepped profile.

The active surface 106 comprises a first active portion 108 arranged downstream of the outlet opening 103 with respect to the advancement direction F. The first active portion 108 extends immediately downstream of the outlet opening 103.

The first active portion 108 is so shaped as to guide the lid 1 during removal from the outlet opening 103 and place the lid 1 in a plane substantially parallel to the top wall of the container 10, i.e. substantially parallel to the plane defined by an upper edge 111 of the neck 9.

The first active portion 108 defines with a side surface 112 of the guide element 105 a driving element 116 that interacts with the end wall 2 of the lid 1 when the lid 1 is retained by the flexible retaining elements 104 and when the lid 1 is removed from the outlet opening 103.

The first active portion 108 comprises a first planar face 113 that places the lid 1 in the above-mentioned plane substantially parallel to the top wall of the container 10 and keeps the lid 1 in position when the container 10 that has received the lid 1 is advanced by the conveying device 101.

The active surface 106 comprises a second active portion 109 arranged downstream of the first active portion 108 with respect to the advancement direction F. In other words, the second active portion 109 is arranged on the opposite side of the first active portion 108 with respect to the outlet opening 103.

The second active portion 109 is so shaped as to press the lid 1 on the neck 9 in order to correctly position the lid 1 with respect to the neck 9.

When the second active portion 109 presses the lid 1 on the neck 9, the top panel of the container 10 may be slightly elastically deformed, i.e. it may pass from a substantially planar configuration to a curved configuration.

The second active portion 109 comprises a second planar face 114 that causes a preliminary engagement, i.e. before the screwing operation, of the lid 1 on the neck 9, so as to avoid that the lid 1 is tilted with respect to the neck 9 and therefore the subsequent screwing operation is made difficult, or even impossible.

The active surface 106 comprises a third active portion 110 arranged downstream of the second active portion 109 with respect to the advancement direction F. In other words, the third active portion 110 is arranged on the opposite side of the second active portion 109 with respect to the first active portion 108.

The second active portion 109 is interposed between the first active portion 108 and the third active portion 110.

The third active portion 110 is so shaped as to allow releasing the pressure generated by the second active portion 109 on the lid 1, and therefore on the container 10.

The third active portion 110 comprises a third planar face 115 that prevents the lid 1 from being expelled from the neck 9 once the second active portion 109 does not pushes the lid 1 on the neck 9 anymore and therefore the top panel of the container 10 moves back from the curved configuration to the substantially planar configuration.

The first active portion 108 is placed at a first distance d1 from the conveying device 100.

The second active portion 109 is placed at a second distance d2 from the conveying device 100.

The third active portion 110 is placed at a third distance d3 from the conveying device 100.

The first distance d1 is greater than the second distance d2.

The third distance d3 is greater than the second distance d2.

The first distance d1 may be different from the third distance d3.

The guide element 105 further comprises a first connecting portion 117 connecting the first planar face 113 and the second planar face 114.

The first connecting portion 117 has a slanted, or curved, configuration.

The distance of the first connecting portion 117 from the conveying device 100 decreases when moving from the first planar face 113 to the second planar face 114, i.e. along the advancement direction F.

The guide element 105 further comprises a second connecting portion 118 connecting the second planar face 114 and the third planar face 115.

The second connecting portion 118 has a slanted, or curved, configuration.

The distance of the second connecting portion 118 from the conveying device 100 increases when moving from the second planar face 114 to the third planar face 115, i.e. along the advancement direction F.

Figure 6:
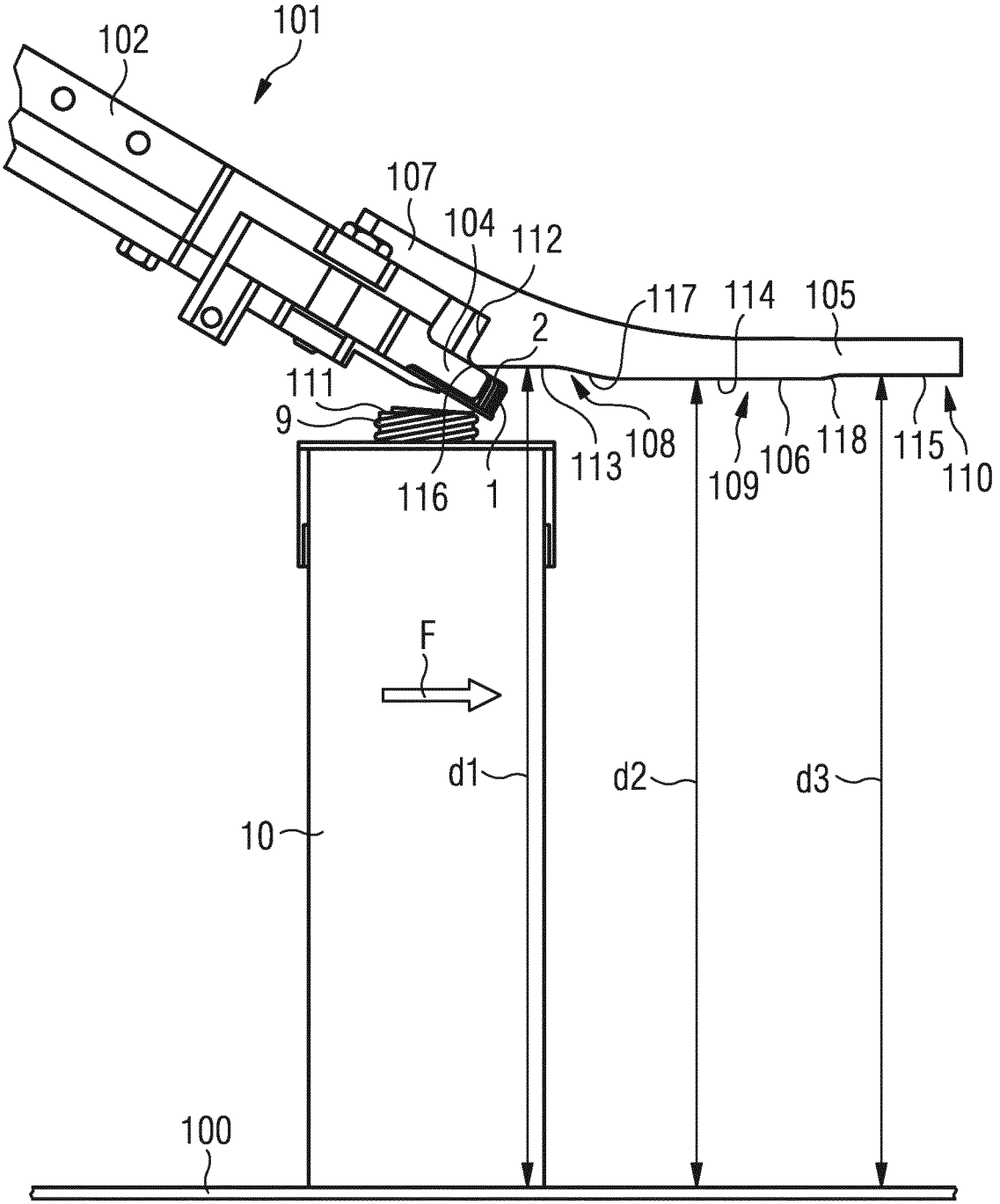
FIGS. 6 to 9 are side views showing the distribution unit of FIG. 5 in successive steps of the application of a lid to a corresponding container.

During operation, as shown in FIG. 6, when a container 10, advanced along the advancement direction F, reaches the chute element 102, the neck 9 of the container 10 interacts with the lid 1 retained by the outlet opening 103 of the distribution unit 101 and removes the lid 1 from the distribution unit 102. In other words, the lid is stripped from the outlet opening 103 located downstream of the chute element 102 by the neck 9 of an underlying container 10.

Figure 7:
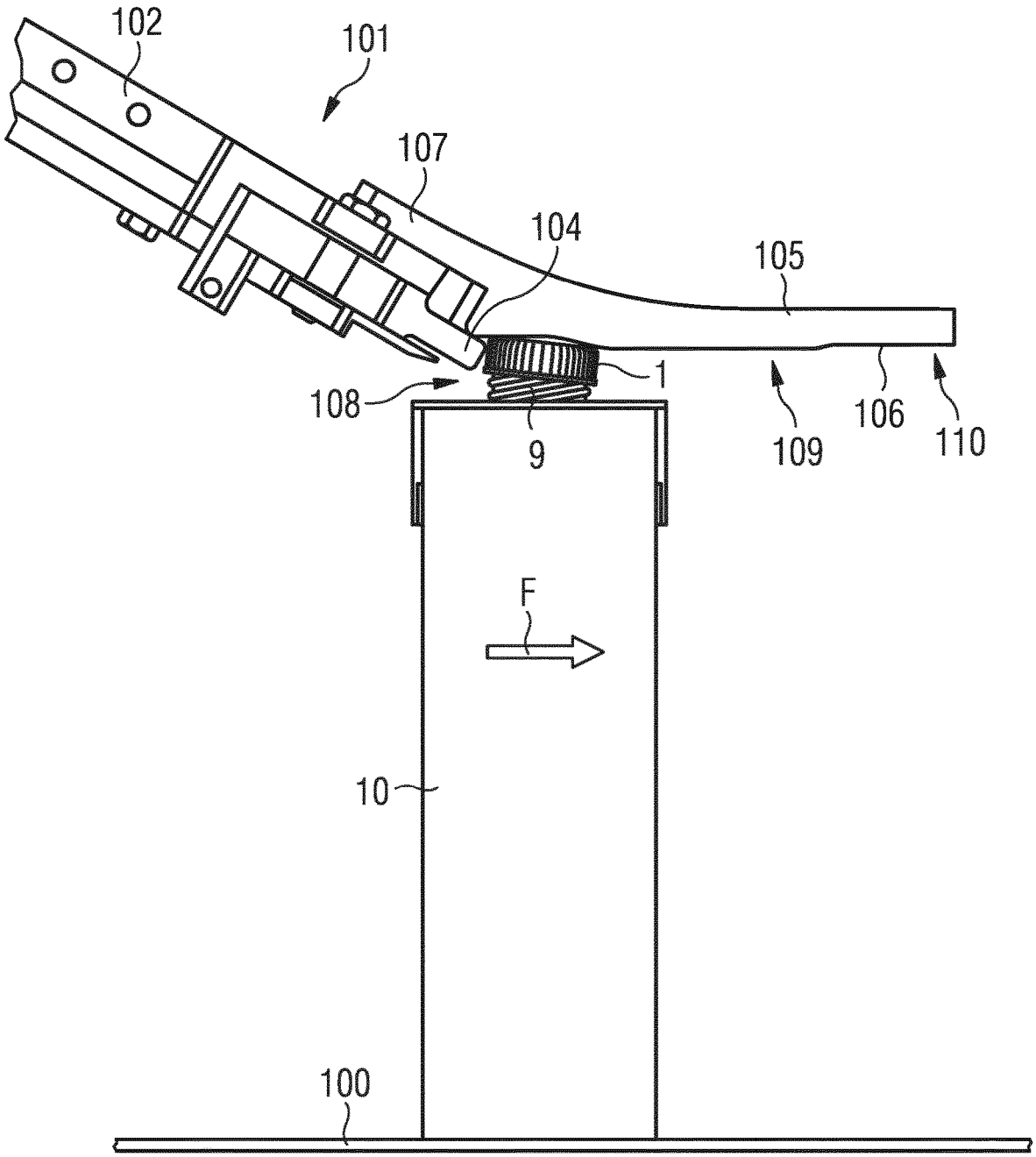

As shown in FIG. 7, the first active portion 108 guides the lid 1 during removal from the outlet opening 103 and places the lid 1 in a plane substantially parallel to the top wall of the container 10, i.e. substantially parallel to the plane defined by the upper edge 111 of the neck 9.

Figure 8:
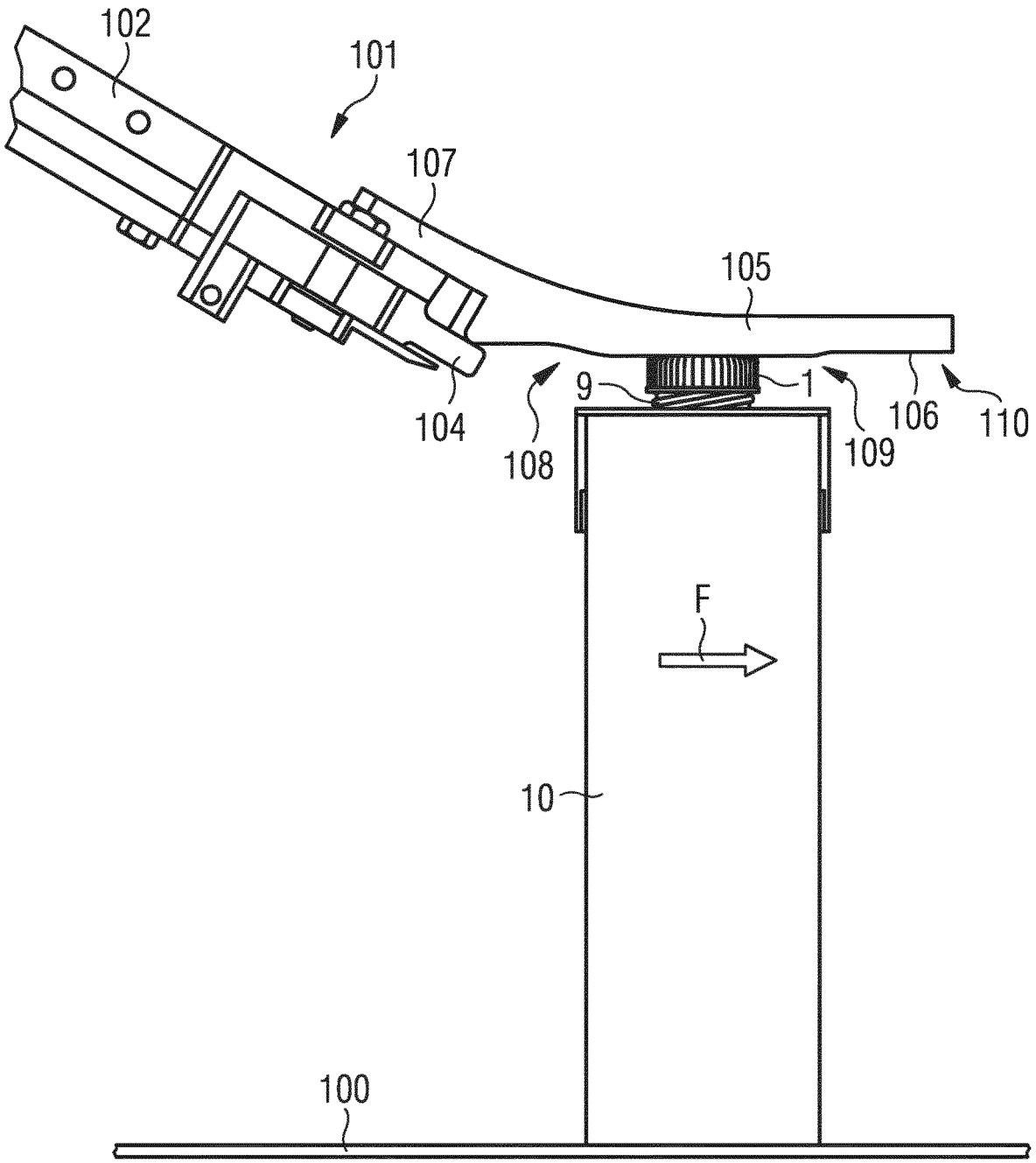

As shown in FIG. 8, the second active portion 109 presses the lid 1 on the neck 9 in order to cause a preliminary engagement of the lid 1 on the neck. In particular, the second active portion 109 correctly positions the lid 1 with respect to the neck 9 and avoids that the lid 1, once placed on the neck 9, is tilted with respect to the neck 9.

The second active portion 109—when pressing the lid 1 on the neck 9—slightly deforms the top panel of the container 10, which passes from a substantially planar configuration to a curved configuration.

Figure 9:
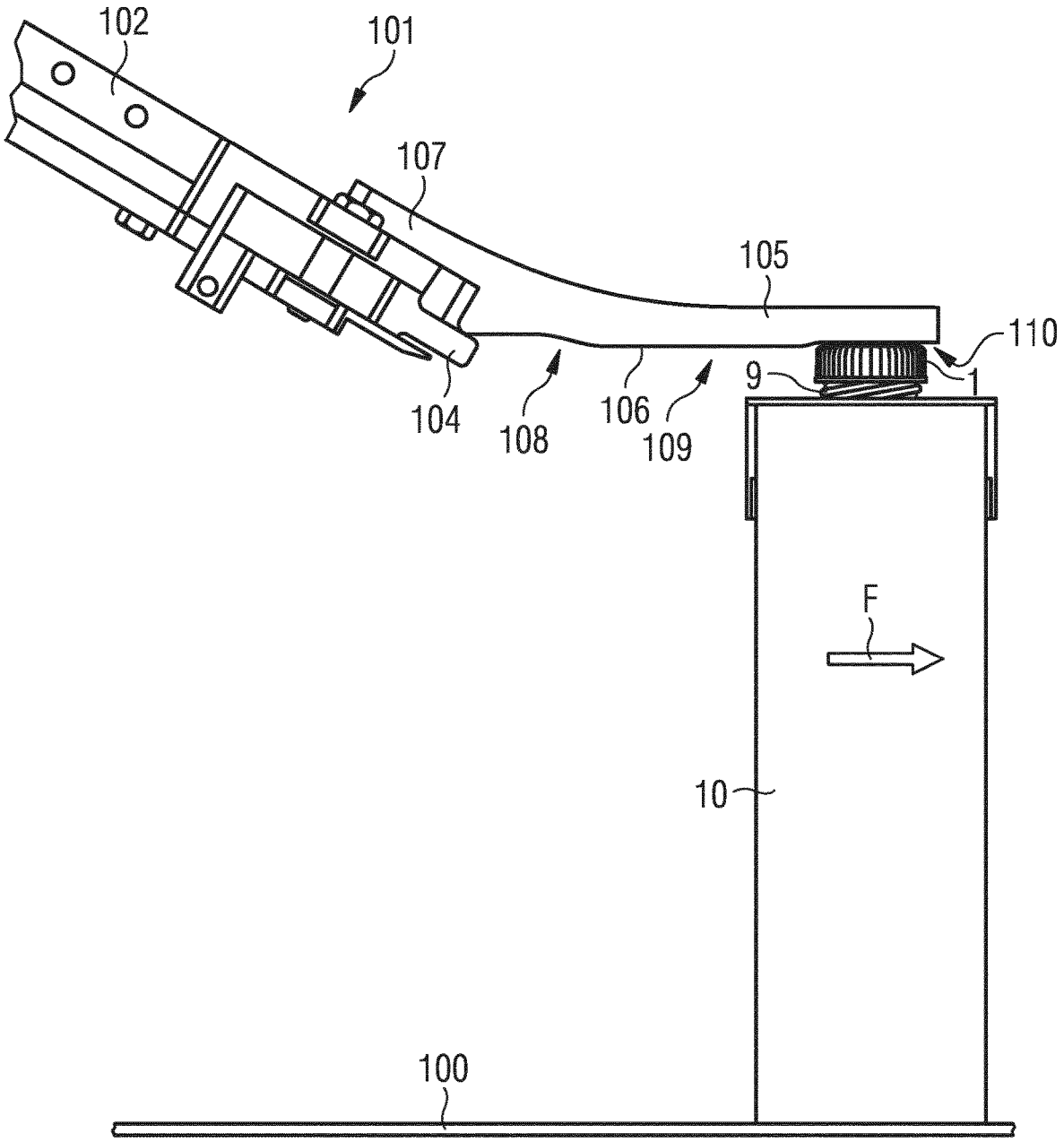

As shown in FIG. 9, the third active portion 110—being placed further away from the conveying device 100 than the second active portion 109—allows the top panel of the container 10 to move back from the curved configuration to the substantially planar configuration and, at the same time, prevents the lid 1 from being expelled from the neck 9 when the deformation due to the pressure exerted by the second active portion 109 is released.

Subsequently, the lid 2 is screwed on the neck 9, as will be better explained in the following.

The apparatus 20 further comprises a group of applying heads 23 for applying the lids 1 to the respective containers 10, particularly by screwing each lid 1 onto a corresponding neck 9 of a container 10.

In the embodiment shown, the group of applying heads comprises two applying heads 23, arranged in sequence along the advancement direction F. However, the group of applying heads may comprise also a number of applying heads 23 different from two, for example three, four or more applying heads 23. Each applying head 23 is arranged to screw a lid 1 onto a corresponding neck 9.

The applying heads 23 are supported by a common support element 24. The support element 24 may be formed in one piece, or may be assembled from a plurality of components that are connected to one another so as to behave, in use, like a single piece.

In the example shown, the support element 24 is shaped as a back plate from which a plurality of projecting walls extend, so as to define a plurality of recesses 25, in each of which an applying head 23 is partially housed. The support element 24 may nevertheless have shapes different from that shown in the drawings.

The applying heads 23 are fitted to the support element 24 so that the distance between two consecutive applying heads 23 is equal to the distance between two consecutive containers 10 advanced along the advancement direction F, i.e. to the pitch of the containers 10.

A movement device 26 is provided for moving the group of applying heads 23 along the advancement direction F, so that each applying head 23 is coupled to an underlying container 10 for a portion of the path thereof along the advancement direction F. In other words, the movement device 26 allows the applying heads 23 to follow the containers 10 with which they interact along a portion of the path of the containers 10. The applying heads 23 are hence movable synchronously with the conveying device 100 that advances the containers 10 in the advancement direction F, along the above mentioned portion of the path of the conveying device 100.

The movement device 26 may comprise a motor 27, possibly connected to a gear box 28, arranged for driving a pulley 30 around which a belt 29 is wound. The belt 29 is further wound around a driven pulley 31. The belt 29 has an active branch that is intended to drive the support element 24 and runs parallelly to the advancement direction F.

A pair of guiding bars 32, each of which extends parallelly to the advancement direction F, is provided for guiding the support element 24 as the latter moves along the advancement direction F. In particular, a sliding element that is not shown is slidable along the guiding bars 32. The support element 24 is fixed relative to the sliding element.

One or more connecting plates, which are not shown, are fastened to the belt 29. The connecting plates are fixed relative to the sliding element mentioned above.

The motor 27 is configured for rotating the pulley 30 in two opposite rotation directions, so that the belt 29 may be driven forwards or backwards parallelly to the advancement direction F.

When the active branch of the belt 29 moves parallelly to the advancement direction F, the support element 24—which, as explained above, is fixed relative to the belt 29—moves together with the belt 29. The applying heads 23, which are supported by the support element 24, are therefore moved forwards or backwards along the advancement direction F. In particular, when the applying heads 23 are moved forwards along the advancement direction F, the applying heads 23 can follow respective containers 10 so that each applying head 23 applies a lid 1 on the corresponding neck 9. After disengaging from respective containers 10, the applying heads 23 can be moved backwards along the advancement direction F so as to be brought back to a starting point at which the applying heads 23 can start to interact with new containers 10.

The movement device 26 thus moves synchronously the applying heads 23, which means that the applying heads 23 are moved together along the advancement direction F by the movement device 26. In other words, the applying heads 23 are moved by the movement device 26 simultaneously and by the same extent, along the advancement direction F.

In an embodiment that is not shown, the movement device may comprise a toothed rack fixed relative to the support element 24. The motor 27 has a shaft coupled to a toothed wheel or pinion that engages with the toothed rack, so as to move the latter forwards or backwards parallelly to the advancement direction F.

More in general, the movement device 26 may comprise any transmission device that is capable of transforming rotation of a shaft of the motor 27 into a linear motion of a linearly movable element fixed relative to the support element 24.

Each applying head 23 comprises a pair of gripping elements 33 intended to interact with the lid 1 for screwing it onto the neck 9. The gripping elements 33 of an applying head 23 are supported by a supporting component 35 connected to a stem 36. Each applying head 23 further comprises a driving device 34 for driving the gripping elements 33. The driving device is fastened to the support element 24. The driving device 34 is directly connected to the stem 36, so as to move the supporting component 35 and hence drive simultaneously both the gripping elements 33.

In particular, the driving device 34 is capable of causing the stem 36 to slide parallelly to the longitudinal axis thereof, thereby displacing the supporting component 35 and hence the gripping elements 33 in a direction parallel to the axis A of a neck 9. The gripping elements 33 can thus be moved towards a lid 1 to be screwed, or alternatively be moved away from a lid 1 that has already been screwed onto the corresponding neck 9. To this end, the driving device 34 may comprise a linear motor.

The driving device 34 is furthermore configured to rotate the stem 36, and hence the supporting component 35 and the gripping elements 33, around a longitudinal axis of the stem 36 that, in use, coincides with the axis A of a neck 9.

By rotating the supporting component 35 around the longitudinal axis of the stem 36, while the latter is moved towards the container 1, the gripping elements 33 move along a helix, thereby screwing the lid 1 onto the neck 9, as will be described in greater detail hereinbelow.

In an embodiment that is not shown, the applying heads 23 may be configured to apply, onto the containers 10, lids 1 that do not comprise the appendages 6, i.e. lids 1 that are delimited by a cylindrical side wall 3.

The apparatus 20 further comprises a plurality of welding heads 43 for induction welding the lid 1 to the protruding portion 17 that projects from the closing element 14. In particular, each welding head 43 is configured to generate in the conductive layer of the welding promoting element 7 an electric current, which melts the heat-sealable layer of the welding promoting element 7 facing the closing element 14. This heat-sealable layer thus adheres to the protruding portion 17, which consequently becomes permanently attached to the lid 1.

The welding heads 43 are arranged downstream of the applying heads 23, along the conveying device 100 that advances the containers 10 in the advancement direction F. The welding heads 43 thus interact with the containers 10 after the applying heads 23 have screwed the lids 1 onto the containers 10.

The number of welding heads 43 may be equal to the number of applying heads 23. In the example shown, two welding heads 43 are provided, but this condition is not essential and the number of welding heads 43 could also be different from two.

The distance between two consecutive welding heads 43 is equal to the distance between two consecutive containers advancing along the advancement direction F. Similarly, the distance between the last applying head and the first welding head 43 is equal to the distance between two consecutive containers 10.

The welding heads 43 are movable forwards and backwards in the advancement direction F, i.e. are movable synchronously with the conveying device 100 that advances the containers 10 in the advancement direction F, along a part of the path of the conveying device 100. Thus, each welding head 43 is capable of following a container 10 in order to interact with the corresponding lid 1 for a time sufficient to ensure welding of the lid 1 to the protruding portion 17. When the lid 1 has been welded to the protruding portion 17, the welding head 43 moves backwards so as to reach an initial position in which it is ready to weld a new lid 1 to the corresponding container 10.

All the welding heads 43 can be moved synchronously by a common mechanism. To this end, all the welding heads 43 can be supported by a common support member 44 so that, by moving the support member 44 in the advancement direction F, all the welding heads 43 are moved together in the advancing direction F forwards or backwards.

In the example shown, the welding heads 43 are moved by the same movement device 26 that also displaces the applying heads 23. The support member 44 is fixed relative to the support element 24, for example because the support member 44 is directly fastened to the support element 24. Thus, when the motor 27 moves the support element 24 by driving the belt 29, the support member 44, and consequently also the welding heads 43, are also displaced in the advancement direction F.

Each welding head 43 comprises an electric induction generating element 51 including a coil that is not shown. By activating the coil, an electric current is induced in the conductive layer of the welding promoting element 7, with a consequent generation of localized heat causing the heat-sealable layer of the welding promoting element 7 facing the neck 9 to be welded to the protruding portion 17.

The welding head 43 comprises an actuator device 52 for displacing the electric induction generating element 51 in a displacement direction arranged transversely, in particular perpendicularly, to the advancement direction F, so as to move the electric induction generating element 51 towards a lid 1 or alternatively away from a lid 1. More precisely, the actuator device 52 is intended to move the electric induction generating element 51 parallelly to the axis of the lid 1 that is being welded.

The actuator device 52 may comprise for example an electric linear motor or a pneumatic actuator.

The above description mainly refers to lids 1 that are intended to be welded to corresponding protruding portions 17 of the closing elements 14. The resulting containers 10 can be opened in a single step, because by unscrewing the lid 1, the closing element 14 is detached from the neck 9.

The apparatus 20 may nevertheless be used also for applying lids 1 that do not comprise the welding promoting element 7. The resulting containers 10 will have to be opened in two steps, by first unscrewing the lid 1 and then removing, for example by means of a pull ring, the closing element 14. In this case, the welding heads 43 are absent, because the apparatus 20 needs simply to screw the lids 1 onto the necks 9. No welding operations need to be carried out onto the lids 1.

In an alternative embodiment, the apparatus 20 may be used to apply, onto the necks 9, lids 1 that are substantially round, i.e. which do not possess the appendages 6.

From the above description it appears that owing to the guide element it is possible to provide a distribution unit that can precisely feed lids to necks of containers, particularly deformable containers made of packaging material having a multilayer structure.

In particular, the first active portion of the guide element places the lids in a plane substantially parallel to the top wall of the container.

The second active portion—by slightly deforming the the top panel of the container from a substantially planar configuration to a curved configuration—presses the lid on the neck in order to cause a preliminary engagement of the lid on the neck.

The third active portion allows the top panel of the container to move back from the curved configuration to the substantially planar configuration and, at the same time, prevents the lid from being expelled from the neck when the deformation due to the pressure exerted by the second active portion is released.

Clearly, changes may be made to the distribution unit as described and illustrated herein without, however, departing from the scope of the present invention as defined in the accompanying claims.

The invention claimed is:

1. A distribution unit for feeding lids to necks of containers, comprising:

a chute element arranged for receiving a row of lids;

a conveyor configured to convey the containers along an advancement direction;

an outlet opening configured to release the lids one at a time, the outlet opening positioned above the conveyor and configured to interact with each container, as each respective container is conveyed by the conveyor, to thereby remove a corresponding lid from the outlet opening; and a guide element having a fastening portion connected to the chute element and an active surface, extending on an opposite side of the chute element with respect to the outlet opening, configured to interact with the lids, the active surface having a stepped profile, wherein the active surface of the guide element includes:

a first active portion that extends from the outlet opening, the first active portion located downstream of the outlet opening with respect to the advancement direction;

a second active portion located on an opposite side of the first active portion with respect to the outlet opening, the second active portion located downstream of the first active portion with respect to the advancement direction; and a third active portion located on an opposite side of the second active portion with respect to the first active portion, the third active portion located downstream of the second active portion with respect to the advancement direction, wherein the first active portion is placed at a first distance from the conveyor, the second active portion is placed at a second distance from the conveyor, and the third active portion is placed at a third distance from the conveyor, the first distance being greater than the second distance and the third distance being greater than the second distance.

2. The distribution unit according to claim 1, wherein the guide element comprises a fastening portion connected to the chute element.

3. The distribution unit according to claim 1, wherein the first active portion includes a first planar face.

4. The distribution unit according to claim 3, wherein the second active portion includes a second planar face.

5. The distribution unit according to claim 4, wherein the third active portion includes a third planar face.

6. The distribution unit according to claim 1, wherein the second active portion is interposed between the first active portion and the third active portion.

7. The distribution unit according to claim 1, wherein the guide element further comprises:

a first connecting portion connecting the first active portion and the second active portion; and a second connecting portion connecting the second active portion and the third active portion.

8. The distribution unit according to claim 7, wherein the first connecting portion and the second connecting portion have a curved configuration.

9. An applying unit for applying lids to necks of containers, the applying unit comprising:

distribution unit according to claim 1; and a group of applying heads configured to screw the lids onto the necks of the containers.

10. The applying unit according to claim 9, wherein the chute element is inclined with respect to the conveyor, such that a distance between the chute element and the conveyor decreases along the advancement direction.

* * * * *